US006994519B2

(12) United States Patent
Palmer et al.

(10) Patent No.: US 6,994,519 B2
(45) Date of Patent: Feb. 7, 2006

(54) APPARATUS AND METHODS FOR COUPLING AXIALLY ALIGNED TURBINE ROTORS

(75) Inventors: Gene David Palmer, Clifton Park, NY (US); Stephen Roger Swan, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 296 days.

(21) Appl. No.: 10/441,086

(22) Filed: May 20, 2003

(65) Prior Publication Data

US 2004/0234371 A1 Nov. 25, 2004

(51) Int. Cl.
*F01D 11/02* (2006.01)

(52) U.S. Cl. ..... 415/174.5; 415/216.1; 415/230

(58) Field of Classification Search ..... 415/174.5, 415/199.5, 216.1, 230
See application file for complete search history.

(56) References Cited

U.S. PATENT DOCUMENTS 2,115,895 A * 5/1938 Weihmann ..... 416/180
3,916,495 A * 11/1975 Klassen et al. ..... 29/888.011

* cited by examiner

*Primary Examiner*—Ninh H. Nguyen
(74) *Attorney, Agent, or Firm*—Nixon & Vanderhye P.C.

(57) ABSTRACT

The coupling between discrete axially aligned first and second turbine shafts includes a flange on one end of one shaft and a rotor wheel on the other shaft. Holes in axial alignment with one another through the flange and rotor wheel receive fastening elements securing the rotor wheel and flange to one another, thereby securing the shaft sections to one another. The fastening elements engage segments on the side of the rotor wheel remote from the flange to facilitate clamping of the flange and rotor wheel to one another. The segments also include outer arcuate surfaces which form sealing surfaces with radially opposed labyrinth teeth of packing ring segments forming part of the turbine diaphragms.

13 Claims, 4 Drawing Sheets

APPARATUS AND METHODS FOR COUPLING AXIALLY ALIGNED TURBINE ROTORS

BACKGROUND OF THE INVENTION

The present invention relates to apparatus and methods for joining adjacent ends of turbine rotor shafts and particularly relates to couplings between axially aligned steam turbine rotor shafts in a manner to reduce bearing-to-bearing span, increase rotor stiffness and enable additional rotor staging or rotor length reduction.

In turbines, particularly steam turbine rotor trains, it is frequently necessary to couple rotor shafts in axial alignment with one another within a given steam path due to material property limitations in the rotor shafts. The coupling requires axial space which adds span to the bearing-to-bearing length. In typical axial couplings for aligned rotor shafts, the axially adjoining rotor shaft ends have flanges with aligned bolt holes enabling the flanges to be bolted directly to one another. It will be appreciated therefore that the shaft end portions mounting the flanges require considerable additional axial extent to accommodate their coupling. This in turn leads to increases in overall span length between bearings with undesirably reduced rotor stiffness. Consequently, it has been found desirable to couple adjoining rotor shaft end portions to one another in a manner with reduced bearing-to-bearing span, thus stiffening the rotor, and enabling tighter clearances and additional turbine staging or rotor length reduction.

BRIEF DESCRIPTION OF THE INVENTION

In accordance with a preferred embodiment of the present invention, there is provided apparatus and methods for coupling the adjacent axially aligned end portions of turbine rotor shafts substantially without increase in axial span of the rotor. To accomplish the foregoing, one of the rotor end portions includes a conventional flange having a circumferential array of holes for receiving fastening elements, e.g., bolts. The opposing end portion, however, includes an adjacent rotor wheel having a circumferential array of openings, i.e., holes, therethrough in alignment with the holes through the flange of the adjoining shaft. Thus, the rotor wheel and flange of the adjoining rotor shaft end portions are secured directly to one another, the fastening elements being received through the aligned holes.

Additionally, a plurality of segments on the side of the rotor wheel remote from the flange, serve in conjunction with the fastening elements, to clamp the flange and rotor wheel to one another. The segments also form seals with the radial opposing diaphragms. The segments have one or more holes therethrough for receiving the fastening elements which join the shaft end portions to one another. The segments also include radially facing arcuate sealing surfaces in radial opposition to the diaphragm seals at an axial location between the rotor wheel and an adjacent rotor wheel on the same shaft. Thus, the segments have seal surfaces which cooperate with the radially opposed labyrinth teeth of the diaphragm seals. As a consequence of this arrangement, additional axial space is gained for additional staging, reduced axial bearing-to-bearing span and increased stiffness, resulting in significant enhanced performance of the turbine.

In a preferred embodiment according to the present invention, there is provided a turbine comprising a rotor having an axis and including discrete first and second axially aligned shafts, a coupling between axially adjacent ends of the shafts including a flange on one of the shafts and a rotor wheel on another of the shafts, the flange and the rotor wheel having circumferentially spaced holes axially aligned with one another and fastening elements received through the aligned holes to secure the flange and the rotor wheel to one another, thereby securing the first and second axially aligned shafts to one another.

In a further preferred embodiment according to the present invention, there is provided a turbine having a flowpath, comprising a rotor having an axis and including first and second axially aligned rotor shafts, the first shaft having an end flange including a plurality of circumferentially spaced holes through the flange, the second shaft including a rotor wheel having a plurality of circumferentially spaced holes aligned with the holes of the flange, threaded nuts in alignment with the holes and located on a side of the wheel remote from the flange and threaded fastening elements extending through the aligned holes and in threaded engagement with the nuts for coupling the flange and rotor wheel to one another.

In a further preferred embodiment according to the present invention, there is provided a method of coupling axially aligned shafts of a turbine rotor to one another, comprising the steps of extending fastening elements through axially aligned holes in an end flange of one of the shafts and a rotor wheel of another of the shafts and securing the fastening elements to the flange and the rotor wheel to secure the shafts to one another.

DETAILED DESCRIPTION OF THE INVENTION

Figure 1:
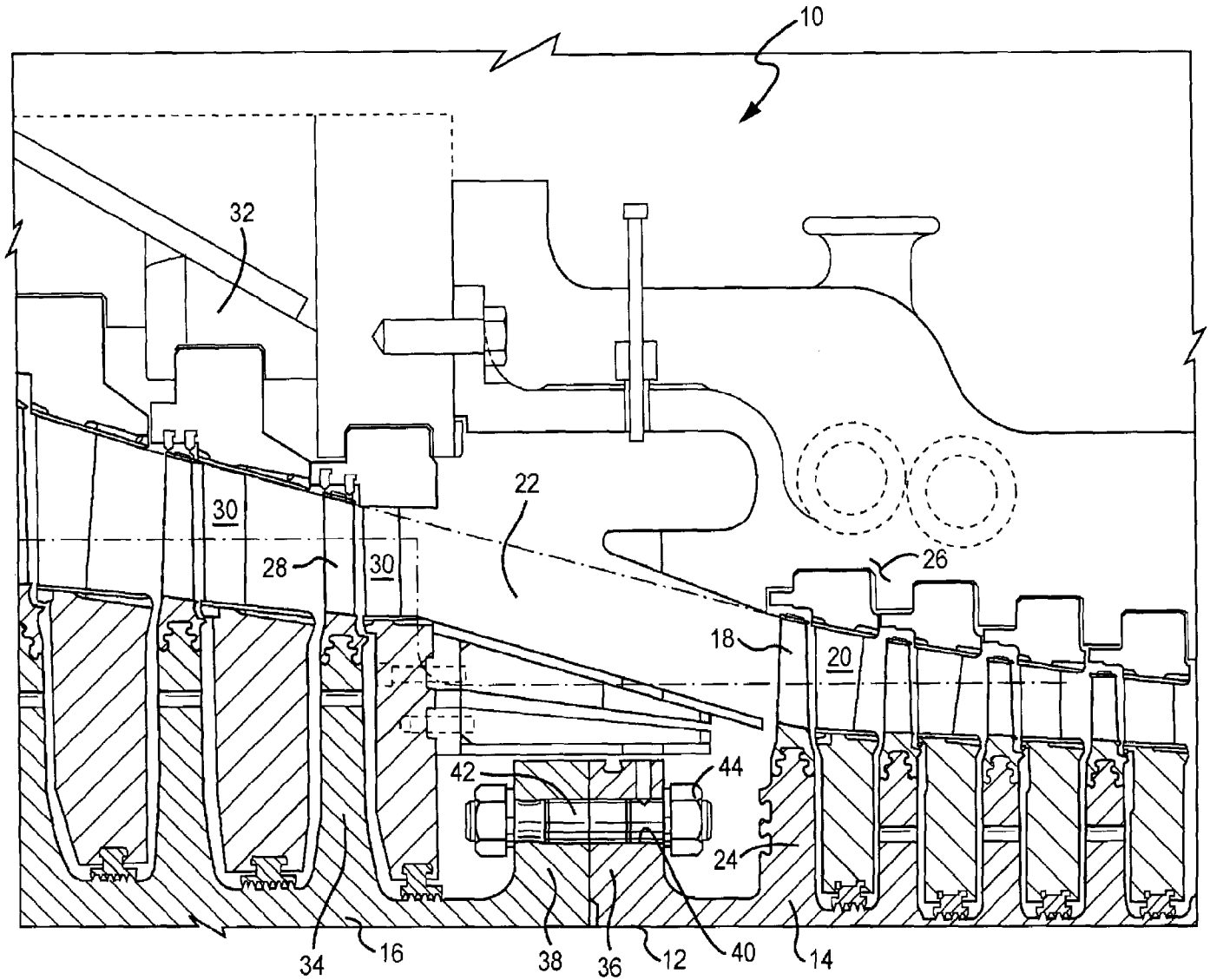
Fig. 1 (Prior Art)
FIG. 1 is a fragmentary cross-sectional view of a portion of a turbine illustrating discrete turbine shafts joined one to the other according to the prior art.

Referring now to the drawing figures, particularly to FIG. 1, there is illustrated a turbine, generally designated 10, and including a rotor 12 formed by axially aligned and joined discrete rotor shafts 14 and 16, respectively. Rotor shaft 14 forms part of an upstream turbine section and includes a plurality of buckets 18 and nozzles 20 forming multiple stages of the turbine 10 and disposed in a hot gas path 22. The buckets 18 are mounted on rotor shaft wheels 24, while the nozzles 20 extend radially inwardly from a fixed casing 26. Similarly, rotor shaft 16 includes a plurality of buckets 28 and nozzles 30 in a downstream turbine section, the nozzles 30 being fixed to the stationary casing 32. Buckets 28 are disposed on turbine wheels 34.

As conventional, the two turbine rotor shafts 14 and 16 are joined together in axial alignment with one another by clamping a pair of flanges 36 and 38 to one another at their junction. The flanges 36 and 38 each have holes 40 aligned with one another for receiving fastening elements 42, for example, studs or bolts. The illustrated studs have nuts 44 at opposite threaded ends and it will be appreciated that bolts with threads at one end and a bolt head at an opposite end may be utilized. As illustrated, the two flanges axially joined to one another require considerable axial spacing of the turbine sections from one another, leading to inefficiencies and degraded performance. Particularly, the bearing-to-bearing span of the rotor is increased, thus rendering the rotor more flexible and inhibiting turbine staging.

Figure 2:
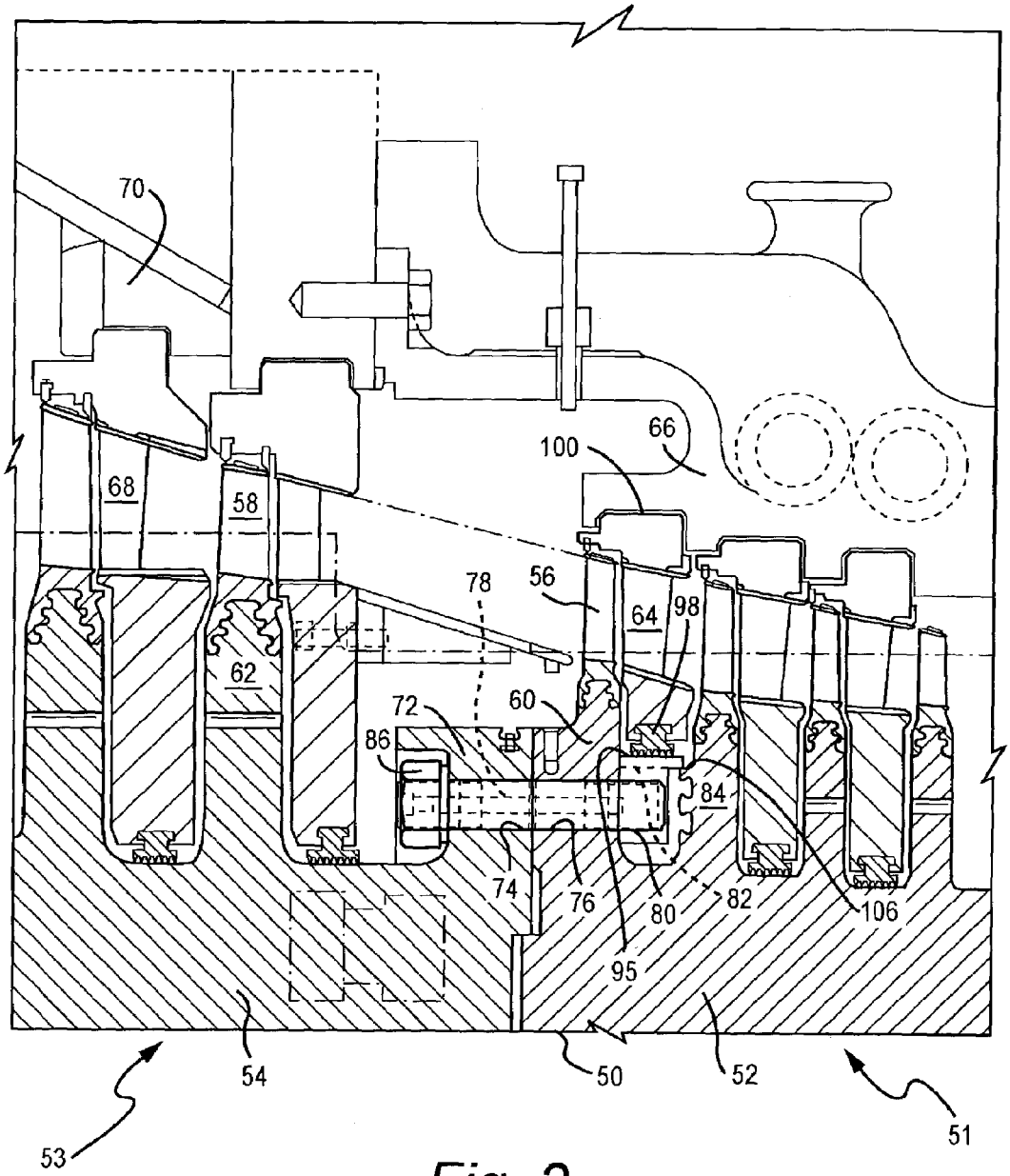
FIG. 2 is a fragmentary cross-sectional view illustrating a coupling between adjoining discrete turbine shafts according to a preferred embodiment of the present invention.
Figure 3:
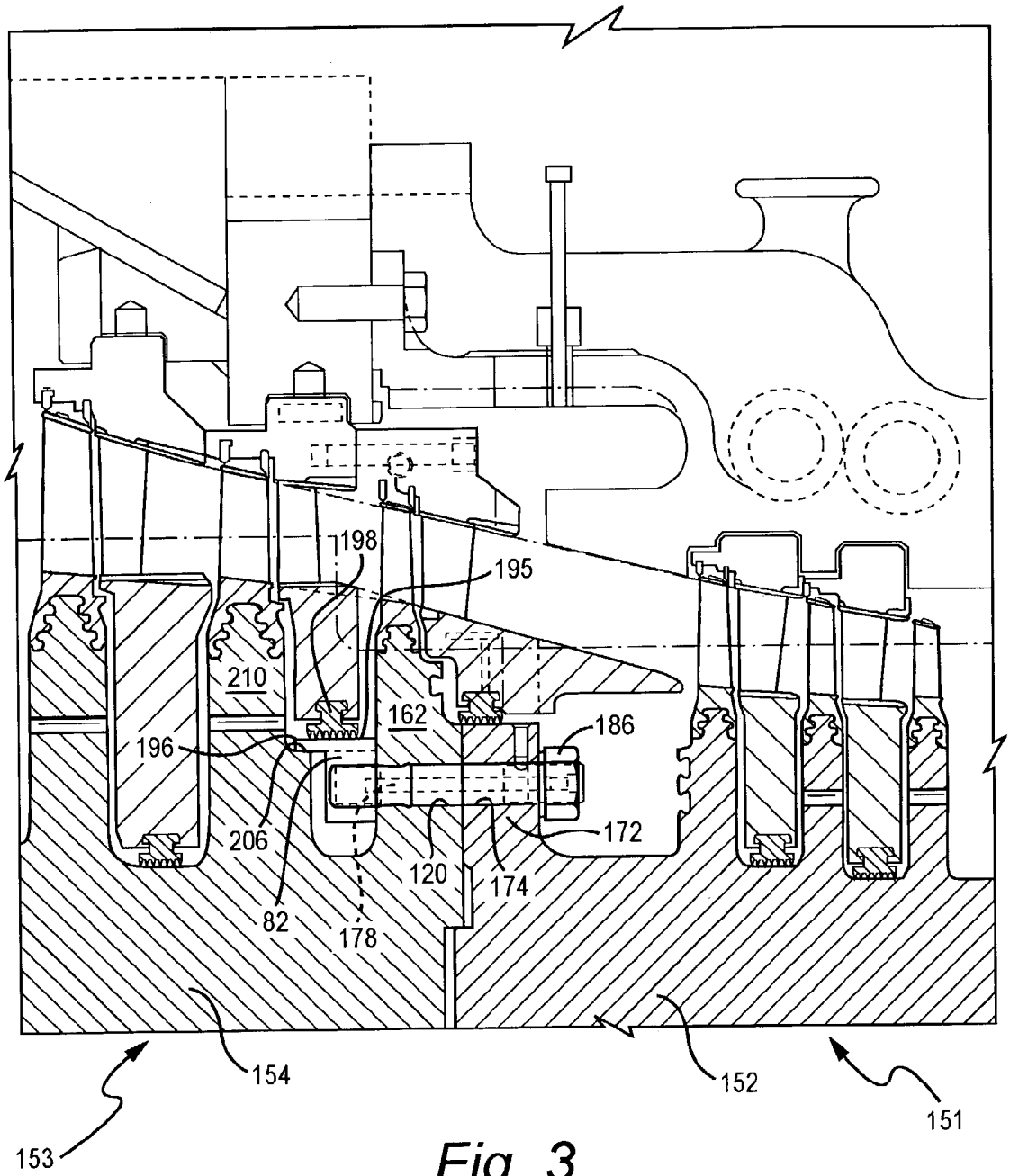
FIG. 3 is a view similar to FIG. 2 illustrating a further embodiment of the present invention.

In accordance with the present invention as illustrated in FIGS. 2 and 3, there is provided unique apparatus and methods for joining adjacent ends of rotor shafts to one another in a manner to reduce bearing-to-bearing span, increase rotor stiffness and enable additional rotor staging or rotor length reduction. To accomplish the foregoing and referring to FIG. 2, there is illustrated, similarly as in FIG. 1, a rotor 50 comprised of upstream and downstream turbine sections 51 and 53, respectively, having rotor shafts 52 and 54 joined axially one to the other. Shafts 52 and 54 mount buckets 56 and 58 on rotor wheels 60 and 62, respectively. Turbine section 51 includes nozzles 64 fixed to the stationary casing 66 while turbine section 53 mounts nozzles 68 fixed to the stationary component 70. In the embodiment illustrated in FIG. 2, the upstream end of the rotor shaft 54 is provided with a conventional flange 72 for joining with the opposing end portion of rotor shaft 52. The flange 72 is provided with circumferentially spaced, axially extending openings 74.

In contrast to the prior art illustrated in FIG. 1, rotor shaft 52 does not include an adjoining flange. Rather, the end portion of the rotor shaft 52 terminates in the last-stage wheel 60 of that turbine section. Wheel 60 includes a plurality of circumferentially spaced, axially extending holes 76 aligned with the holes 74 through the flange 72 of shaft 54. To secure the shafts 52 and 54 to one another, fastening elements 78 are passed through the aligned openings 74 and 76. Each fastening element 78 may comprise a bolt or stud with at least one end 80 having threads for threaded engagement with female threads on a nut or segment 82 disposed between the last-stage wheel 60 adjacent the end of turbine shaft 52 and the next upstream wheel 84 of turbine section 52. It will be appreciated that the nuts or segments 82 are circumferentially spaced one from the other, located between the adjacent wheels 60 and 84 of turbine section 52 and, when the ends of the fastening elements 78 are threadedly received, facilitate clamping of the flange 72 and wheel 60 to one another. The opposite end of the fastening element may comprise a nut 86 or the head of a bolt. Consequently, with this arrangement, the shafts 52 and 54 are coupled to one another by the engagement of fastening elements through flanges on one shaft and a rotor wheel on the adjoining shaft.

Figure 4:
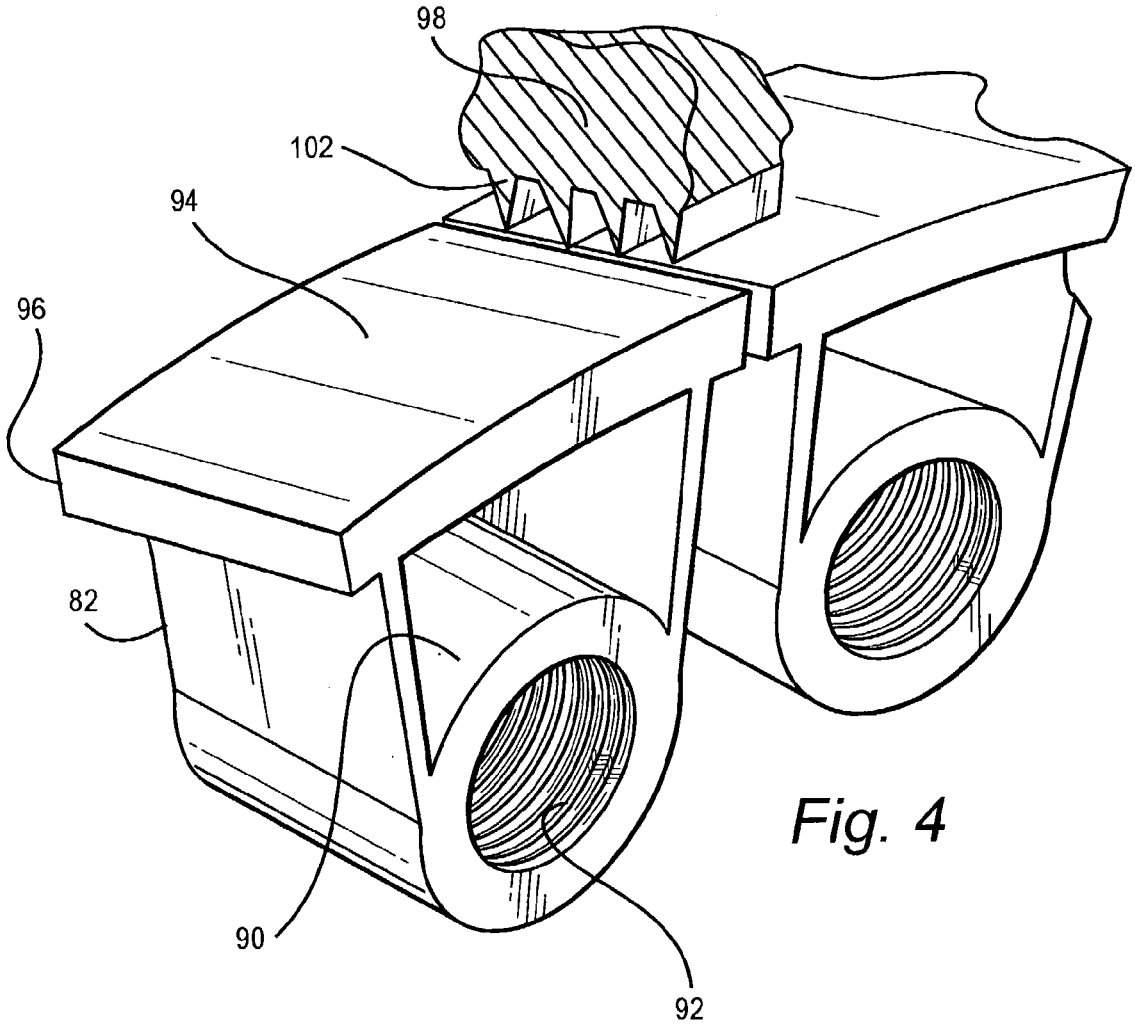
FIG. 4 is a perspective view of segments which form part of the coupling between adjoining rotor shafts.

Referring to FIG. 4, each segment 82, in addition to a hub 90 carrying the female threads 92, has a radially outer sealing surface 94 and a flange 96 which projects axially from the hub 90. It will be appreciated that when the segments 82 are secured to the wheel 60, the segments are circumferentially aligned with one another. The sealing surfaces 94 of the segments 82 form a circular seal surface 95 extending 360° about the rotor shaft 52. The sealing surfaces 94 lie in radial opposition to packing ring segments 98 carried by the diaphragms 100 of the stationary component. The packing ring segments 98 mount labyrinth seal teeth 102 (FIG. 4) which provide inter-stage seals. Consequently, the segments 82 facilitate the clamping of the adjoining shafts 52 and 54 to one another, as well as afford part of the inter-stage seals between adjacent wheels. Further, the axially extending flange 96 on the segments 82 overlies a shoulder or rim 106 formed on the next-adjacent upstream wheel 84. The flanges 96 and the shoulder 106 cooperate with one another in conjunction with the fastening elements 78 to prevent the segments 82 from rotating about the axis of the fastening elements 78. The shoulder 106 is preferably, but need not be, necessarily circular about the axis of the turbine rotor. Thus, the cooperating surfaces of the flanges 96 and shoulder 106 provide an anti-rotation feature for each segment 82.

In the embodiment of FIG. 2, the segments are located on the upstream turbine section 51 and shaft 52. In the embodiment illustrated in FIG. 3, the segments 82 are located on the downstream turbine section shaft. In FIG. 3, like reference numerals are applied to like parts as in the preceding embodiment, advanced by "100." In the embodiment of FIG. 3, the upstream turbine section 151 and shaft 152 mount a conventional radially extending flange 172 with holes 174 circumferentially spaced one from the other. The downstream turbine section 153 and shaft 154 mount a first stage wheel 162 which has holes 120 circumferentially spaced one from the other and in alignment with the holes 174 through flange 172. Consequently, to secure the shafts 152 and 154 to one another, fastening elements 178 are passed through the aligned holes 174 and 120. The threaded end of each fastening element 178 is threaded into the female threaded hub 90 of segment 82, clamping the rotor wheel 162 and flange 172 to one another and, hence, clamping the shaft sections 152 and 154 to one another. The opposite end of the fastening element 178 may, as in the preceding embodiment, comprise a bolt head or a nut 186. In this form, the segments 82 are reversed in axial configuration such that the flanges 196 overlie the rim 206 about the next stage rotor wheel 208 of turbine section 210 in a downstream direction. Thus, the arrangement in FIG. 3 is the opposite of the arrangement in FIG. 2. Note also that the surfaces 94 of the segments 82 lie in radial opposition to packing ring segments 198 on the diaphragms of the downstream turbine section 153 whereby the packing ring segment and segment 82 form inter-stage seals.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine comprising:

a rotor having an axis and including discrete first and second axially aligned shafts;

a coupling between axially adjacent ends of said shafts including a flange on one of said shafts and a rotor wheel on another of said shafts, said flange and said rotor wheel having circumferentially spaced holes axially aligned with one another;

fastening elements received through said aligned holes to secure said flange and said rotor wheel to one another, thereby securing said first and second axially aligned shafts to one another;

a diaphragm located on one side of the rotor wheel remote from the flange and carrying diaphragm seals; and a plurality of seal segments located adjacent said one rotor wheel side and engageable with said fastening elements, said seal segments having sealing surfaces for sealing cooperation with the diaphragm seals.

2. A turbine according to claim 1 wherein said rotor wheel carries buckets extending into a flowpath along the turbine, said fastening elements including studs threaded at one end for threaded engagement with the seal segments to clamp the flange and the rotor wheel to one another, thereby to secure the first and second shafts to one another.

3. A turbine according to claim 1 wherein said rotor wheel carries a plurality of buckets extending into a flowpath along the turbine, said seal segments and said diaphragm being disposed downstream of said rotor wheel.

4. A turbine according to claim 1 wherein said rotor wheel carries a plurality of buckets extending into a flowpath along the turbine, said seal segments and said diaphragm being disposed upstream of said rotor wheel.

5. A turbine according to claim 1 wherein said seal segments are spaced circumferentially one from another about the axis of the rotor, said seal surfaces being arcuate about the rotor axis, said diaphragm carrying a plurality of labyrinth teeth for forming a seal with said seal surfaces of said segments.

6. A turbine according to claim 1 including a second wheel on said another shaft and having an arcuate rim, said seal segments having arcuate flanges overlying the wheel rim, said fastening elements engageable with said seal segments radially inwardly of said rim and seal segment flanges whereby said arcuate flanges and said rim cooperate to preclude rotation of the seal segments about the fastening elements.

7. A turbine according to claim 1 wherein said seal segments and said another shaft have cooperating parts preventing rotation of said seal segments about the fastening elements.

8. A turbine having a flowpath, comprising:

a rotor having an axis and including first and second axially aligned rotor shafts;

said first shaft having an end flange including a plurality of circumferentially spaced holes through the flange, said second shaft including a rotor wheel having a plurality of circumferentially spaced holes aligned with the holes of said flange;

threaded nuts in alignment with said holes and located on a side of said wheel remote from said flange;

threaded fastening elements extending through said aligned holes and in threaded engagement with said nuts for coupling the flange and rotor wheel to one another; and a diaphragm carried by the turbine axially downstream of the rotor wheel of the second shaft and carrying diaphragm seals, said nuts carrying sealing surfaces for sealing cooperation with the diaphragm seals.

9. A turbine having a flowpath, comprising:

a rotor having an axis and including first and second axially aligned rotor shafts;

said first shaft having an end flange including a plurality of circumferentially spaced holes through the flange, said second shaft including a rotor wheel having a plurality of circumferentially spaced holes aligned with the holes of said flange;

threaded nuts in alignment with said holes and located on a side of said wheel remote from said flange;

threaded fastening elements extending through said aligned holes and in threaded engagement with said nuts for coupling the flange and rotor wheel to one another; and each nut including an axially extending flange for overlying a shoulder on an axially adjacent downstream wheel of said rotor wheel of the second shaft.

10. A turbine having a flowpath, comprising:

a rotor having an axis and including first and second axially aligned rotor shafts;

said first shaft having an end flange including a plurality of circumferentially spaced holes through the flange, said second shaft including a rotor wheel having a plurality of circumferentially spaced holes aligned with the holes of said flange;

threaded nuts in alignment with said holes and located on a side of said wheel remote from said flange;

threaded fastening elements extending through said aligned holes and in threaded engagement with said nuts for coupling the flange and rotor wheel to one another; and a diaphragm carried by the turbine axially upstream of the rotor wheel of the second shaft and carrying diaphragm seals, said nuts carrying sealing surfaces for sealing cooperation with the diaphragm seals.

11. A turbine according to claim 10 wherein each said nut includes an axially extending flange for overlying a shoulder on an axially adjacent upstream wheel of said rotor wheel of the second shaft.

12. A method of coupling axially aligned shafts of a turbine rotor to one another, comprising the steps of:

extending fastening elements through axially aligned holes in an end flange of one of said shafts and a rotor wheel of another of said shafts;

securing said fastening elements to said flange and said rotor wheel to secure the shafts to one another;

securing the fastening elements and seal segments to one another on a side of said rotor wheel remote from said flange with said seal segments in radial alignment with a turbine diaphragm; and providing cooperable sealing surfaces on said seal segments and said diaphragm for sealing therebetween.

13. A method according to claim 12 wherein the seal segments are circumferentially spaced from one another about the axis of said rotor and including preventing said seal segments from rotation about the fastening elements.

* * * * *